US008716994B2

(12) United States Patent
Bhuiyan et al.

(10) Patent No.: US 8,716,994 B2
(45) Date of Patent: May 6, 2014

(54) ANALOG CIRCUIT CONFIGURED FOR FAST, ACCURATE STARTUP

(75) Inventors: Ekram H. Bhuiyan, San Jose, CA (US); Steve X. Chi, Cupertino, CA (US)

(73) Assignee: SanDisk Technologies Inc., Plano, TX (US)

( * ) Notice: Subject to any disclaimer, the term of this patent is extended or adjusted under 35 U.S.C. 154(b) by 13 days.

(21) Appl. No.: 13/551,844

(22) Filed: Jul. 18, 2012

(65) Prior Publication Data

US 2014/0002045 A1 Jan. 2, 2014

Related U.S. Application Data

(60) Provisional application No. 61/667,259, filed on Jul. 2, 2012.

(51) Int. Cl.
*G05F 1/56* (2006.01)
*G05F 1/563* (2006.01)

(52) U.S. Cl.
USPC ..... 323/274; 323/269; 323/901

(58) Field of Classification Search
USPC ..... 323/273, 274, 275, 901, 268, 269; 363/49
See application file for complete search history.

(56) References Cited

U.S. PATENT DOCUMENTS

| | | | | |
|---|---|---|---|---|
| 5,892,381 | A | 4/1999 | Koifman et al. | |
| 6,445,167 | B1 * | 9/2002 | Marty | 323/280 |
| 6,784,652 | B1 | 8/2004 | Aude | |
| 6,815,941 | B2 * | 11/2004 | Butler | 323/313 |
| 7,002,329 | B2 * | 2/2006 | Agari et al. | 323/284 |
| 7,362,079 | B1 | 4/2008 | Maheedhar et al. | |
| 7,391,187 | B2 * | 6/2008 | Rasmus | 323/226 |
| 7,557,428 | B2 | 7/2009 | Kunitomo et al. | |
| 7,639,097 | B2 | 12/2009 | Tran | |
| 7,642,759 | B2 * | 1/2010 | Dobkin | 323/269 |
| 7,675,273 | B2 * | 3/2010 | Ko et al. | 323/269 |
| 7,755,419 | B2 | 7/2010 | Rao et al. | |
| 8,080,989 | B2 | 12/2011 | Jo | |
| 2007/0241738 | A1 | 10/2007 | Baranauskas et al. | |
| 2010/0301909 | A1 | 12/2010 | Schindler | |

FOREIGN PATENT DOCUMENTS

| | | |
|---|---|---|
| EP | 2 230 579 | 9/2010 |
| WO | 93/16427 | 8/1993 |

OTHER PUBLICATIONS

PCT International Search Report and Written Opinion dated Sep. 2, 2013, issued in PCT/US2013/046542.

* cited by examiner

*Primary Examiner* — Gary L Laxton
(74) *Attorney, Agent, or Firm* — Weaver Austin Villeneuve & Sampson LLP

(57) ABSTRACT

Techniques and circuits are described by which analog circuits may be quickly driven to desired states at startup in a fast and accurate manner.

12 Claims, 2 Drawing Sheets

ANALOG CIRCUIT CONFIGURED FOR FAST, ACCURATE STARTUP

RELATED APPLICATION DATA

The present application claims priority under 35 U.S.C. 119(e) to U.S. Provisional Patent Application No. 61/667,259 filed Jul. 2, 2012, the entire disclosure of which is incorporated herein by reference for all purposes.

BACKGROUND OF THE INVENTION

The present invention relates to analog circuits and, in particular, to analog circuits that quickly and accurately reach a desired state at startup.

Analog circuits such as, for example, reference circuits and regulators are often required to turn on very fast, e.g., within a few hundred nanoseconds. In addition, such circuits may also be required to converge to a particular state (e.g., an output reference voltage level) with a high level of accuracy within the very fast turn-on time. This is particularly important for systems in which different functional blocks may be selectively placed in low-power or standby modes for power management purposes. Such blocks must be able to "wake up" quickly to full power on demand without undesirably interrupting or delaying system operation.

One common technique for achieving a fast turn-on time involves the use of a clamp circuit to quickly charge a circuit node or network very close to a desired level. The drawback with this technique is that it may not provide the required level of accuracy for all applications due to variation in the devices used to implement the clamp circuit, e.g., variation in a diode voltage or the threshold voltage of a transistor.

Another common technique involves the temporary use of a high bias current at startup to increase the slew rate of the slower components of the circuit (e.g., operational amplifiers) connected to the target network or node. This approach can be highly accurate in that it uses the same circuit to generate the state for both the startup and steady-state conditions. However, high bias currents often result in instability for certain load conditions, and therefore present undesirably complex design issues.

SUMMARY OF THE INVENTION

According to the present invention, a fast and accurate startup circuit is provided. According to a particular implementation, a circuit includes a steady-state block including steady-state circuitry, a load coupled to the steady-state circuitry and representing a load condition, and a steady-state bias current source configured to provide a steady-state bias current to the steady-state circuitry during steady-state operation. A startup block includes startup circuitry and a startup bias current source configured to provide a startup bias current to the startup circuitry during a startup mode. The startup bias current is substantially larger than the steady-state bias current. The startup circuitry has operational characteristics substantially similar to the steady-state circuitry but without the load condition such that, during the startup mode, the startup circuitry is configured to drive a common node to which both the startup circuitry and the steady-state circuitry are connected to a desired state. The desired state is substantially the same as achieved by the steady-state circuitry during steady-state operation with the load condition.

According to another implementation, a circuit includes a steady-state block including a voltage regulator having a first stage and a second stage, a load coupled to the voltage regulator and representing a load condition, and a steady-state bias current source configured to provide a steady-state bias current to at least a portion of the voltage regulator during steady-state operation. A startup block includes startup circuitry and a startup bias current source configured to provide a startup bias current to the startup circuitry during a startup mode. The startup bias current is substantially larger than the steady-state bias current. The startup circuitry is substantially the same schematically as the first and second stages of the voltage regulator, and has operational characteristics substantially similar to the first and second stages of the voltage regulator but without the load condition such that, during the startup mode, the startup circuitry is configured to drive a common node to a desired state. The common node is between the first and second stages of the voltage regulator. The desired state is substantially the same as achieved by the first stage of the voltage regulator during steady-state operation with the load condition.

According to another implementation, a method of operating a circuit is provided. The circuit includes a startup block including startup circuitry and a startup bias current source configured to provide a startup bias current. The circuit further includes a steady-state block including steady-state circuitry, a load coupled to the steady-state circuitry and representing a load condition, and a steady-state bias current source configured to provide a steady-state bias current. The startup bias current is substantially larger than the steady-state bias current. The startup circuitry has operational characteristics substantially similar to the steady-state circuitry but without the load condition. The startup bias current is provided to the startup circuitry during a startup mode thereby driving a common node to which both the startup circuitry and the steady-state circuitry are connected to a desired state. The desired state is substantially the same as achieved by the steady-state circuitry during steady-state operation with the load condition. The startup circuitry is disabled once the desired state is reached. The steady-state bias current is provided to the steady-state circuitry during steady-state operation.

A further understanding of the nature and advantages of the present invention may be realized by reference to the remaining portions of the specification and the drawings.

DETAILED DESCRIPTION OF SPECIFIC EMBODIMENTS

Reference will now be made in detail to specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the following description, specific details are set forth in order to provide a thorough understanding of the present invention. The present invention may be practiced without some or all of these specific details. In addition, well known features may not have been described in detail to avoid unnecessarily obscuring the invention.

According to a particular class of embodiments, a startup block is provided to drive a target network or node of an analog circuit to a desired state during a startup mode. The startup block is schematically a substantial replica of a portion of the analog circuit that drives the target network or node under steady-state conditions (i.e., the steady-state block), except that the startup block does not include the load driven by the steady-state block. An example of a particular implementation is shown in FIG. 1.

Figure 1:
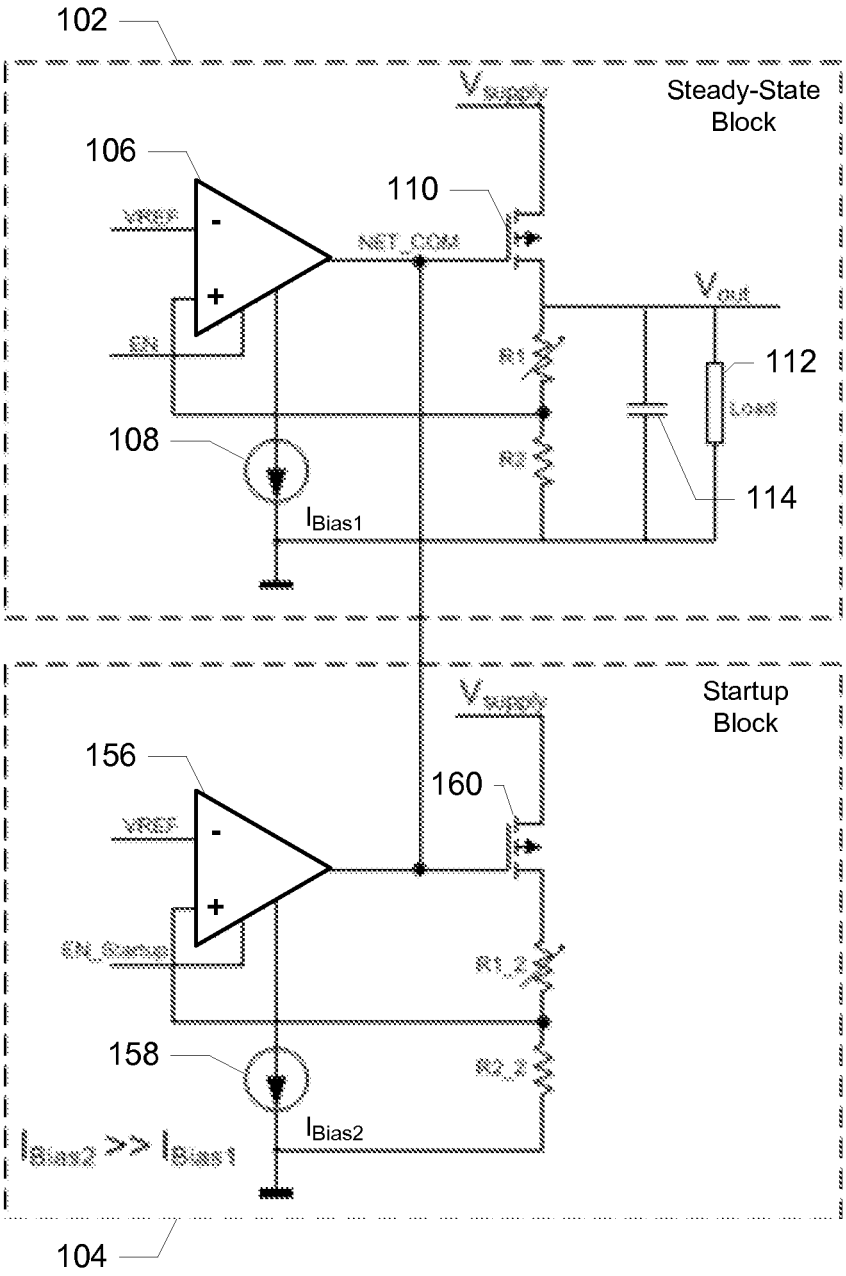
FIG. 1 is a simplified schematic diagram of a specific implementation of an analog circuit configured for a fast and accurate startup.

FIG. 1 shows a simplified schematic diagram of a steady-state block 102 and an associated startup block 104. In the depicted implementation, steady-state block 102 is a voltage regulator. However, as will be understood, steady-state block 102 may include any of a wide variety of analog circuits including, for example, a reference circuit. The scope of the present disclosure should therefore not be limited to voltage regulators or any particular type of analog circuit.

The voltage regulator of steady-state block 102 includes a $1^{st}$ stage which includes an operational amplifier 106 biased by a current source 108 ($I_{Bias1}$). Op amp 106 drives a $2^{nd}$ stage including a power switch 110 and a resistor divider (variable resistor R1 and resistor R2) that provides feedback to op amp 106. The $2^{nd}$ stage of steady-state block 102 drives a load 112 and an output capacitor 114.

During steady-state operation (when signal EN is enabled and signal EN_Startup is disabled), when Vout goes above a desired regulation point, the feedback voltage at the non-inverting input of op amp 106 is correspondingly high, exceeding VREF at the inverting input and driving the voltage at NET_COM high. This turns off power switch 110, causing capacitor 114 to discharge (via the series resistance of R1 and R2), and bringing the feedback voltage at the non-inverting input of op amp 106 down. When this voltage goes below VREF, the output of op amp 106 drives the voltage at NET_COM low, turning power switch 110 on, connecting load 112 to Vsupply and charging capacitor 114. By connecting and disconnecting load 112 and capacitor 114 to Vsupply in this way, the output voltage Vout supplied to load 112 is regulated at a desired level.

The bias current provided to op amp 106 by current source 108 during steady-state operation (i.e., $I_{Bias1}$) is set at a level intended to ensure the stability of steady-state block 102. However, as discussed above, such a bias current is typically inadequate to enable op amp 106 to drive the target network at its output to the desired state (e.g., to bring the voltage at NET_COM to a desired level) sufficiently fast to satisfy system requirements. Therefore, during a startup mode, startup block 104 is enabled (via the signal EN_Startup) to drive a substantially similar target network and to bring the voltage at NET_COM to the desired level.

As shown in FIG. 1, much of startup block 104 is substantially the same schematically as steady-state block 102, including a first stage op amp 156 driving a second stage that includes power switch 160 and a resistor divider including resistors R1_2 and R2_2. According to various implementations, some or all of these components are sufficiently well matched with the corresponding components of steady-state block 102 so that they present a substantially similar target network. An important difference in the depicted implementation is that startup block 104 does not include an output capacitor or a load. Another important difference is that op amp 156 is biased by a current source 158 that provides a bias current $I_{Bias2}$ that is significantly greater than the bias current provided to op amp 106 by current source 108.

Bias current $I_{Bias2}$ is set such that the slew rate of op amp 156 is sufficiently high to allow startup block 104 to drive its target network to the desired state and bring the voltage at NET_COM to the desired voltage. Once this is achieved, startup block 104 may be disabled (by disabling EN_Startup), leaving op amp 106 to drive its target network. According to some implementations, steady-state block 102 may be enabled during the startup mode given that its contribution to the driving of the target network will be dominated by that of startup block 104 and its much higher bias current. Alternatively, steady-state block 102 may be disabled during all or part of the startup mode.

Because the target network presented by the components of startup block 104 is substantially similar to that presented by the corresponding components of steady-state block 102, the voltage at NET_COM resulting from the startup mode is substantially the same as the desired steady-state voltage, therefore providing a desired level of accuracy within the fast startup period. It should be noted that the level of accuracy may be adjusted by adjusting the level of matching of the respective components of steady-state block 102 and startup block 104.

In addition, because the target network presented by startup block 104 does not experience the load conditions experienced by steady-state block 102 during steady-state operation, the voltage at NET_COM may be quickly and accurately driven to the desired level without the stability issues that would otherwise be present if op amp 106 were driven by a similar bias current.

Figure 2:
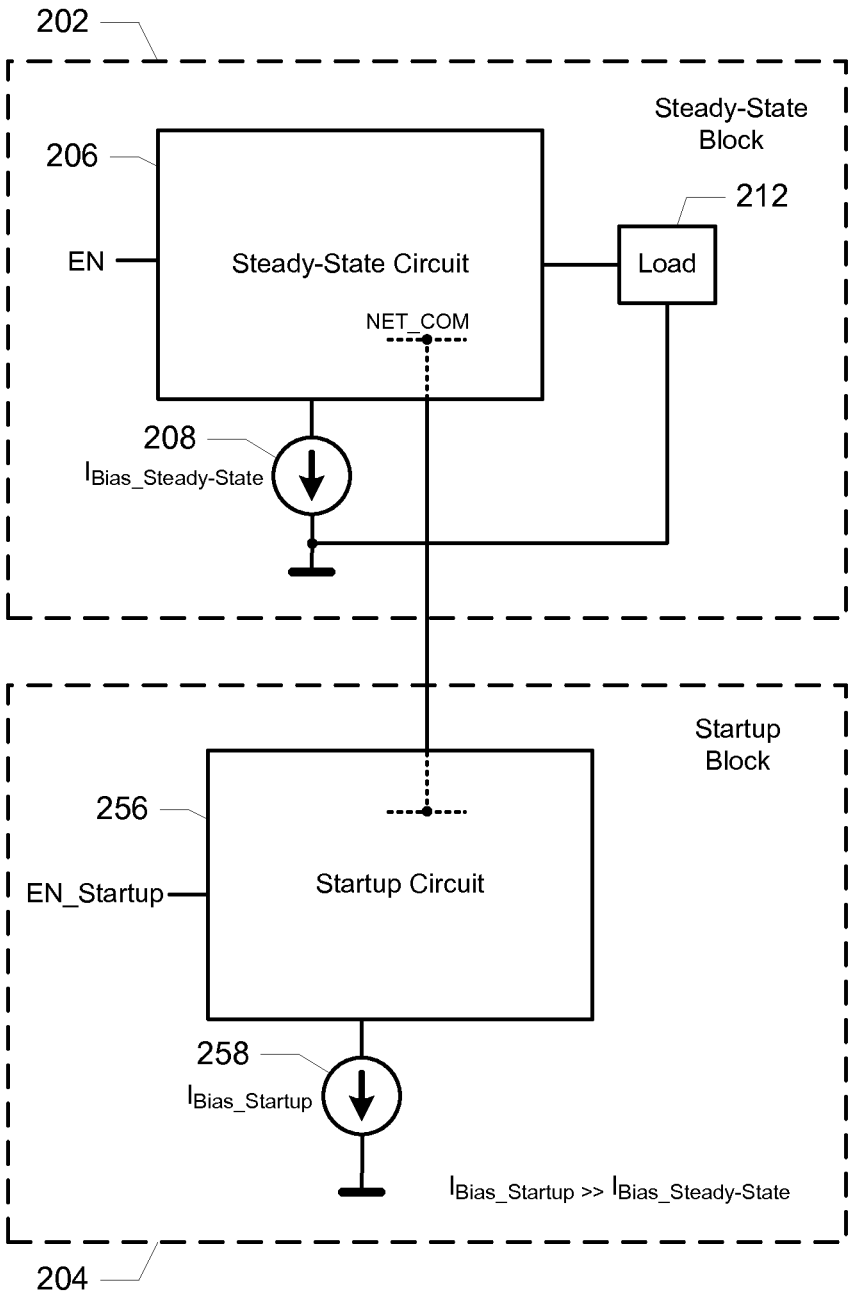
FIG. 2 is a simplified schematic diagram of another implementation of an analog circuit configured for a fast and accurate startup.

A more general implementation is illustrated in FIG. 2. As with the more specific implementation illustrated in FIG. 1, the implementation of FIG. 2 includes a steady-state block 202 and a startup block 204. As discussed above, steady-state block 202 may be any of a wide variety of analog circuits for which a fast and accurate startup is desired. For example, steady-state block 202 may correspond to a voltage regulator (as discussed with reference to FIG. 1), a reference circuit, etc. Thus, steady-state circuit 206 may include a wide variety of circuit types and topologies.

Under steady-state conditions, steady-state circuit 206 is connected to a load 212, and bias current ($I_{Bias_Steady\text{-}State}$) is provided to at least a portion of steady-state circuit 206 by current source 208. During a startup mode, startup block 204 is enabled (via the signal EN_Startup) to bring the voltage at NET_COM to a desired level. This is achieved by the application of a bias current ($I_{Bias_Startup}$) to startup circuit 256 via current source 258 which is significantly larger than the bias current provided by current source 208 to steady-state circuit 206. Once this is achieved, startup block 204 may be disabled.

Bias current $I_{Bias_Startup}$ is set such that the slew rate of startup circuit 256 is sufficiently high to allow startup block 204 to drive its target network to the desired state and bring the voltage at NET_COM to the desired voltage within the required startup time (e.g., as imposed by system requirements). Because startup circuit 256 has operational characteristics that are substantially similar to steady-state circuit 206 and a much higher bias current, the voltage at NET_COM is driven to the desired level with the accuracy otherwise achievable by steady-state circuit 206, but in a much shorter period of time. In addition, because startup circuit 256 does not experience the same load conditions as steady-state circuit 206 does under steady-state operation, the desired fast and accurate startup is achieved in a stable manner.

While the invention has been particularly shown and described with reference to specific embodiments thereof, it will be understood by those skilled in the art that changes in the form and details of the disclosed embodiments may be made without departing from the spirit or scope of the invention. For example, according to various implementations, the components of the startup block may vary in some respects relative to those of the steady-state block and still operate in the manner described. As long as the operational behavior of the startup block and the steady-state block is substantially similar (e.g., over process, voltage and temperature), the desired operation may be achieved. For example, in the implementation illustrated in FIG. 1, power switch 160 need not physically match power switch 110 to ensure that the voltage at NET_COM reaches the desired level. That is, given the steady-state power requirements of a voltage regulator, power switch 110 might be implemented as a relatively large array of transistors in parallel. However, because power switch 160 does not have the same power requirements, it might be implemented as a smaller array, or even a single transistor. Similarly, op amp 156 may be a smaller device than op amp 106 as long as it behaves substantially similarly in the way it drives its target network. Other suitable variations will be apparent to those of skill in the art.

In another example, various implementations may be implemented using any of a variety of standard or proprietary CMOS processes. However, it should be noted that implementations are contemplated that may employ a much wider range of semiconductor materials and manufacturing processes including, for example, GaAs, SiGe, etc. Fast startup circuits as described herein may be represented (without limitation) in software (object code or machine code in non-transitory computer-readable media), in varying stages of compilation, as one or more netlists (e.g., a SPICE netlist), in a simulation language, in a hardware description language (e.g., Verilog, VHDL), by a set of semiconductor processing masks, and as partially or completely realized semiconductor devices (e.g., an ASIC). The various alternatives for each of the foregoing as understood by those of skill in the art are also within the scope of the invention.

Finally, although various advantages, aspects, and objects of the present invention have been discussed herein with reference to various embodiments, it will be understood that the scope of the invention should not be limited by reference to such advantages, aspects, and objects. Rather, the scope of the invention should be determined with reference to the appended claims.

What is claimed is:

1. A circuit, comprising:

a steady-state block including steady-state circuitry, a load coupled to an output node of the steady-state circuitry and representing a load condition, and a steady-state bias current source configured to provide a steady-state bias current to the steady-state circuitry during steady-state operation; and a startup block including startup circuitry and a startup bias current source configured to provide a startup bias current to the startup circuitry during a startup mode, the startup bias current being significantly larger than the steady-state bias current;

wherein the startup circuitry has operational characteristics substantially similar to the steady-state circuitry but without the load condition such that, during the startup mode, the startup circuitry is configured to drive a common node to which both the startup circuitry and the steady-state circuitry are connected to a desired state, the common node being different than the output node of the steady state circuitry, the desired state being substantially the same as achieved by the steady-state circuitry during steady-state operation with the load condition.

2. The circuit of claim 1 wherein the startup circuitry is substantially the same schematically as a portion of the steady-state circuitry.

3. The circuit of claim 1 wherein the startup circuitry is schematically identical to the steady-state circuitry.

4. The circuit of claim 1 wherein the steady-state block comprises a voltage regulator or a reference circuit.

5. The circuit of claim 1 wherein the startup bias current is selected to achieve a particular slew rate for one or more components of the startup circuitry.

6. The circuit of claim 1 wherein the startup block is configured to be enabled only during the startup mode.

7. A circuit, comprising:

a steady-state block including a voltage regulator having a first stage and a second stage, a load coupled to the voltage regulator and representing a load condition, and a steady-state bias current source configured to provide a steady-state bias current to at least a portion of the voltage regulator during steady-state operation; and a startup block including startup circuitry and a startup bias current source configured to provide a startup bias current to the startup circuitry during a startup mode, the startup bias current being significantly larger than the steady-state bias current, the startup circuitry being substantially the same schematically as the first and second stages of the voltage regulator;

wherein the startup circuitry has operational characteristics substantially similar to the first and second stages of the voltage regulator but without the load condition such that, during the startup mode, the startup circuitry is configured to drive a common node to a desired state, the common node being between the first and second stages of the voltage regulator, the desired state being substantially the same as achieved by the first stage of the voltage regulator during steady-state operation with the load condition.

8. The circuit of claim 7 wherein the startup circuitry is schematically identical to the first and second stages of the voltage regulator.

9. The circuit of claim 7 wherein the startup bias current is selected to achieve a particular slew rate for one or more components of the startup circuitry.

10. The circuit of claim 9 wherein the one or more components comprises an operational amplifier.

11. The circuit of claim 7 wherein the startup block is configured to be enabled only during the startup mode.

12. A method of operating a circuit, the circuit comprising a startup block including startup circuitry and a startup bias current source configured to provide a startup bias current, the circuit further comprising a steady-state block including steady-state circuitry, a load coupled to an output node of the steady-state circuitry and representing a load condition, and a steady-state bias current source configured to provide a steady-state bias current, the startup bias current being significantly larger than the steady-state bias current, the startup circuitry having operational characteristics substantially similar to the steady-state circuitry but without the load condition, the method comprising:

providing the startup bias current to the startup circuitry during a startup mode thereby driving a common node to which both the startup circuitry and the steady-state circuitry are connected to a desired state, the common node being different than the output node of the steady state circuitry, the desired state being substantially the same as achieved by the steady-state circuitry during steady-state operation with the load condition;

disabling the startup circuitry once the desired state is reached; and providing the steady-state bias current to the steady-state circuitry during steady-state operation.

* * * * *